US005829292A

United States Patent [19]

Andriessen

[11] Patent Number: 5,829,292

[45] Date of Patent: Nov. 3, 1998

[54] ROLLING ANNULAR WORKPIECES

[75] Inventor: Ronald Carl Andriessen, Cheltenham, England

[73] Assignee: Formflo Limited, England

[21] Appl. No.: 863,608

[22] Filed: May 27, 1997

[30] Foreign Application Priority Data

May 24, 1996 [GB] United Kingdom ..... 9610957

[51] Int. Cl.[6] ..... B21H 1/12

[52] U.S. Cl. ..... 72/110; 72/108

[58] Field of Search ..... 72/11.1, 15.3, 72/17.3, 30.2, 81, 107, 108, 110

[56] References Cited

FOREIGN PATENT DOCUMENTS 1 475 777 7/1974 United Kingdom .
1 475 778 7/1974 United Kingdom .
1 475 779 7/1974 United Kingdom .
1 475 780 7/1974 United Kingdom .

OTHER PUBLICATIONS

"Cold roll forming moves into top gear", Machinery and production Engineering, vol. 132, No. 3411, May 17, 1978, pp. 25–28, Burgess Hill GB.

*Primary Examiner*—Lowell A. Larson
*Attorney, Agent, or Firm*—Wallenstein & Wagner, Ltd.

[57] ABSTRACT

An annular workpiece 6 is rolled between two oppositely disposed forming rolls 2, 4, and two oppositely disposed growth rolls 22 and 24 acting at right angles to the line of action of the forming rolls. The forming rolls 2, 4, are brought together to roll form the workpiece 6 to a wall thickness dependent upon its weight, and the advance of the growth control rolls 22, 24 is controlled to a position which is also dependent upon the weight of the workpiece 6.

7 Claims, 4 Drawing Sheets

FIG. 4

| *SUPPORT ROLL CORRECTION FACTOR (mm/g)* | *0* | | | *0.04* | | | *-0.04* | | |
|---|---|---|---|---|---|---|---|---|---|
| *AT FULL DEPTH* | MIN WT | NOM WT | MAX WT | MIN WT | NOM WT | MAX WT | MIN WT | NOM WT | MAX WT |
| WEIGHT (g) | 395 | 400 | 405 | 395 | 400 | 405 | 395 | 400 | 405 |
| WALL THICKNESS CORRECTION FACTOR (mm/g) | 0.02 | 0.02 | 0.02 | 0.02 | 0.02 | 0.02 | 0.02 | 0.02 | 0.02 |
| WALL THICKNESS (mm) | 9.9 | 10 | 10.1 | 9.9 | 10 | 10.1 | 9.9 | 10 | 10.1 |
| a HORIZONTAL BORE | 80 | 80 | 80 | 80 | 80 | 80 | 80 | 80 | 80 |
| b HORIZONTAL OUTSIDE DIAMETER (mm) | 99.8 | 100 | 100.2 | 99.8 | 100 | 100.2 | 99.8 | 100 | 100.2 |
| c VERTICAL BORE (mm) | 84.2 | 84 | 83.8 | 84 | 84 | 84 | 84.4 | 84 | 83.6 |
| c VERTICAL OUTSIDE DIAMETER (mm) | 104 | 104 | 104 | 103.8 | 104 | 104.2 | 104.2 | 104 | 103.8 |
| *AFTER ROUNDING* | | | | | | | | | |
| BORE (mm) | 82.1 | 82 | 81.9 | 82 | 82 | 82 | 82.2 | 82 | 81.8 |
| OUTSIDE DIAMETER (mm) | 101.9 | 102 | 102.1 | 101.8 | 102 | 102.2 | 102 | 102 | 102 |
| | *CONSTANT MEAN DIAMETER* | | | *CONSTANT BORE* | | | *CONSTANT OUTSIDE DIAMETER* | | |

ROLLING ANNULAR WORKPIECES

BACKGROUND TO THE INVENTION

This invention relates to the rolling of annular workpieces. Particularly it relates to rolling processes controlled with reference to the weight of the workpiece being rolled.

Various known rolling techniques achieve different effects by control of various rolling parameters. On certain annular shaped components produced by rolling it is beneficial to have a very accurate outside diameter or inside diameter or to equally share these variations between the outside and inside diameters. Our British Patent Specification Nos. 1,475,777; 1,475,778; 1,475,779; and 1,475,780, to which reference is directed, disclose rolling techniques useful in achieving at least some of these effects.

SUMMARY OF THE INVENTION

The present invention is directed at a technique broadly of the type described in Specification No. 1,475,777, in which the forming rolls in a rolling machine are controlled in relation to the weight of the workpiece being rolled. Specifically, the present invention is a development of a rolling machine of the type comprising two oppositely disposed forming rolls, at least one of which is movable towards and away from the other, and two oppositely disposed sets of growth control rolls having a line of action at right angles to the line of action of the forming rolls; and means for weighing a workpiece to be rolled. According to the invention, means are provided for controlling the advance both of the forming rolls and the growth control rolls in relation to signals from the weighing means. Advance of the growth control rolls is typically controlled by stops, and the advance of both sets of rolls may be controlled in relation to the weight of a workpiece to be rolled relative to that of a nominal workpiece.

BRIEF DESCRIPTION OF THE DRAWINGS

The invention will now be described by way of example and with reference to the accompanying schematic drawings in which:-

FIG. 4 shows the different types of diameter control that can be obtained using varying support roll positions.

DESCRIPTION OF THE PREFERRED EMBODIMENT

Figure 1:
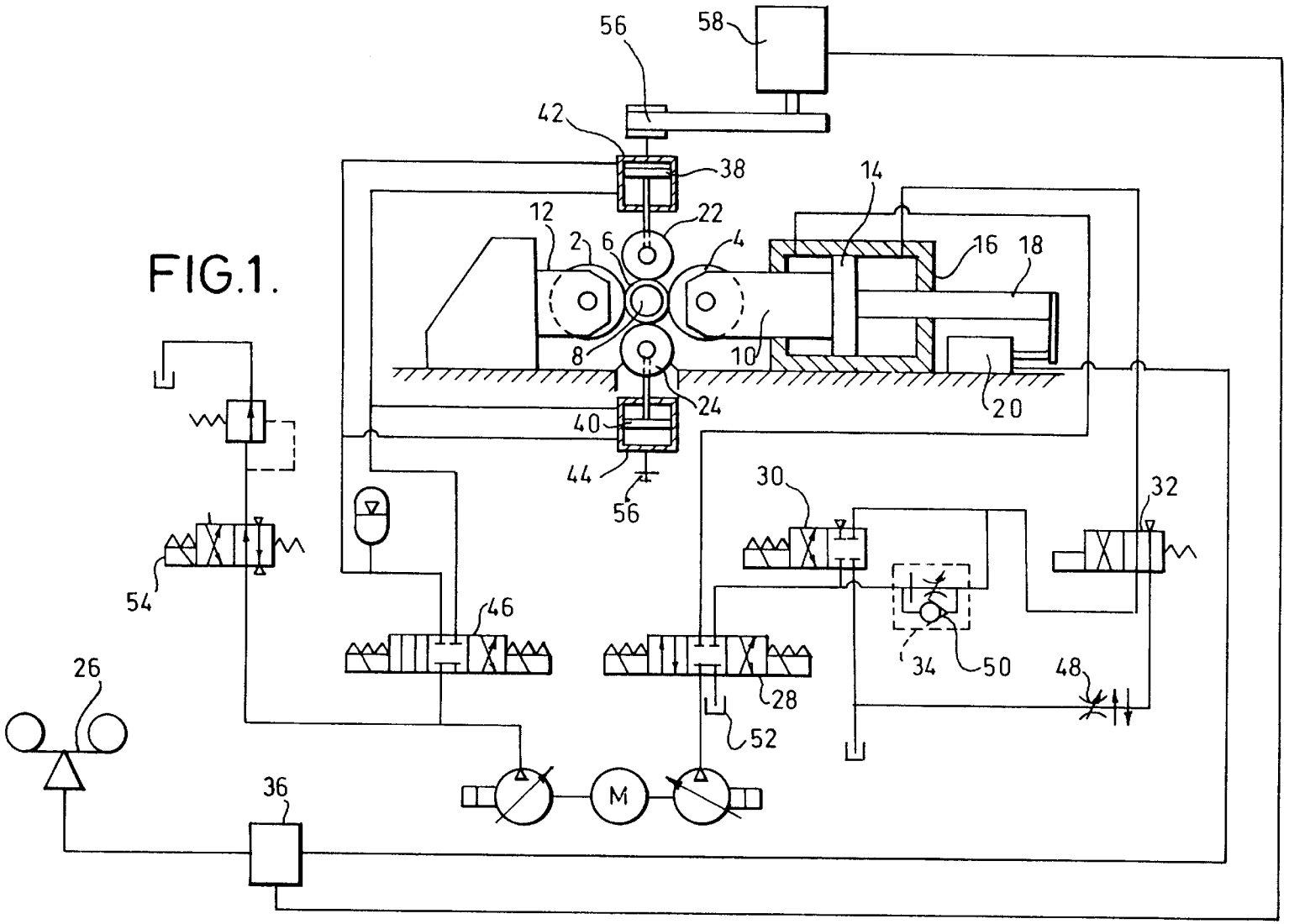
FIG. 1 shows a side view of a rolling machine for rolling a profile into the surfaces of an annular workpiece, together with a hydraulic circuit for operating the machine.

The rolling machine in FIG. 1 has two opposed forming rolls 2 and 4, between which is supported an annular workpiece 6 on a mandrel 8. The mandrel can be, for example, a split mandrel as described in U.K. Patent Specification 1,475,780. In the embodiment shown in FIG. 1 only the right hand roll 4 can be moved horizontally towards and away from the workpiece 6 but a rolling machine having both forming rolls moveable can be used. This would involve only a simple change in the hydraulic circuitry. Both forming rolls 2 and 4 are each supported in a respective yoke 12 and 10. Yoke 12 is fixed but yoke 10 is connected to a piston 14 which is movable inside a cylinder 16. The piston is in turn connected by means of a piston rod 18 to a digital or analogue transducer 20.

At right angles to the forming rolls 2 and 4 are two sets of opposed growth control rolls 22 and 24 for reducing any ovality in the workpiece 6 produced by the forming rolls 2 and 4 during rolling. The growth control rolls are rotatably supported by any suitable means such as that described in U.K. Patent Specification 1,329,251.

Prior to the rolling operation the annular workpiece 6 to be rolled is weighed in a weighing unit 26. The difference in weight between the workpiece 6 under consideration and a nominally sized workpiece produces a digital or analogue output signal during rolling. After weighing the workpiece 6 is inserted in the rolling machine ready for the start of the rolling operation. A method of roll forming using this technique is disclosed in U.K. Patent Specification 1,475,777.

To advance the forming roll 4 hydraulic fluid is passed to a changeover valve 28, which is set in the position which allows fluid to be conveyed to the back of the piston 14 to advance the roll 4. From the changeover valve 28 the hydraulic fluid passes via two other changeover valves 30 and 32 to the back of piston 14 which is thereby made to advance under the pressure of the fluid. The initial advancement of the forming roll 4 is relatively fast, but when the forming roll 4 is nearly in contact with the workpiece 6 its speed of advancement is slowed down by switching the changeover valve 30 so that the hydraulic fluid passes though a flow control valve 34.

As the forming roll 4 advances its movement is converted by the transducer 20 to a signal, such as a voltage, which is compatible with that produced by the weighing unit 26, and these two signals are compared in a unit 36. When the signals from the transducer 20 and the weighing unit 26 correspond, the unit 36 switches the changeover valve 28 to prevent hydraulic fluid continuing to flow to the back of piston 14.

When the forming roll 4 is fully advanced it remains in the advanced position for a period of time known as the dwell time. The extent of advancement of the forming roll 4 or the dwell time depends on the difference between the weight of the workpiece being rolled and the weight of a nominally sized workpiece.

As mentioned above the rolling machine also includes two sets of growth control rolls 22 and 24. Each growth control roll 22 and 24 is connected to a respective piston 38 and 40 which is movable inside a cylinder 42 and 44. During rolling, hydraulic fluid is supplied to the backs of the pistons 38 and 40 via a changeover valve 46. This allows the pistons 38 and 40 to advance as the form is produced in the workpiece, keeping the growth control rolls 22 and 24 in contact with the workpiece 6 with sufficient force to prevent the workpiece from distorting to any large extent.

When the forming roll 4 reaches a predetermined depth of roll the force exerted by the growth control rolls is increased as described below. After completion of the dwell time, the changeover valve 28 is switched so that hydraulic fluid can pass to the front of piston 14 thereby causing the forming roll 4 to retract. The retraction of the forming roll 4 in turn causes hydraulic fluid to flow to the changeover valve 32 which is now set so that fluid passes through a slow retraction control valve 48. This control valve 48 limits the speed with which the forming roll can retract. The roll is initially retracted slowly to prevent any distortion in the shape of the rolled workpiece which could occur if the forming rolls 4 were retracted too fast. After the forming roll 4 has been retracted a predetermined distance its speed of retraction can safely be increased. This is effected by switching the changeover valve 32 so that hydraulic fluid flows through check valve 50 then back to a hydraulic fluid reservoir 52 via the changeover valve 28. Slow forming roll retraction is disclosed in U.K. Patent Specification 1,475,778.

Figure 2:
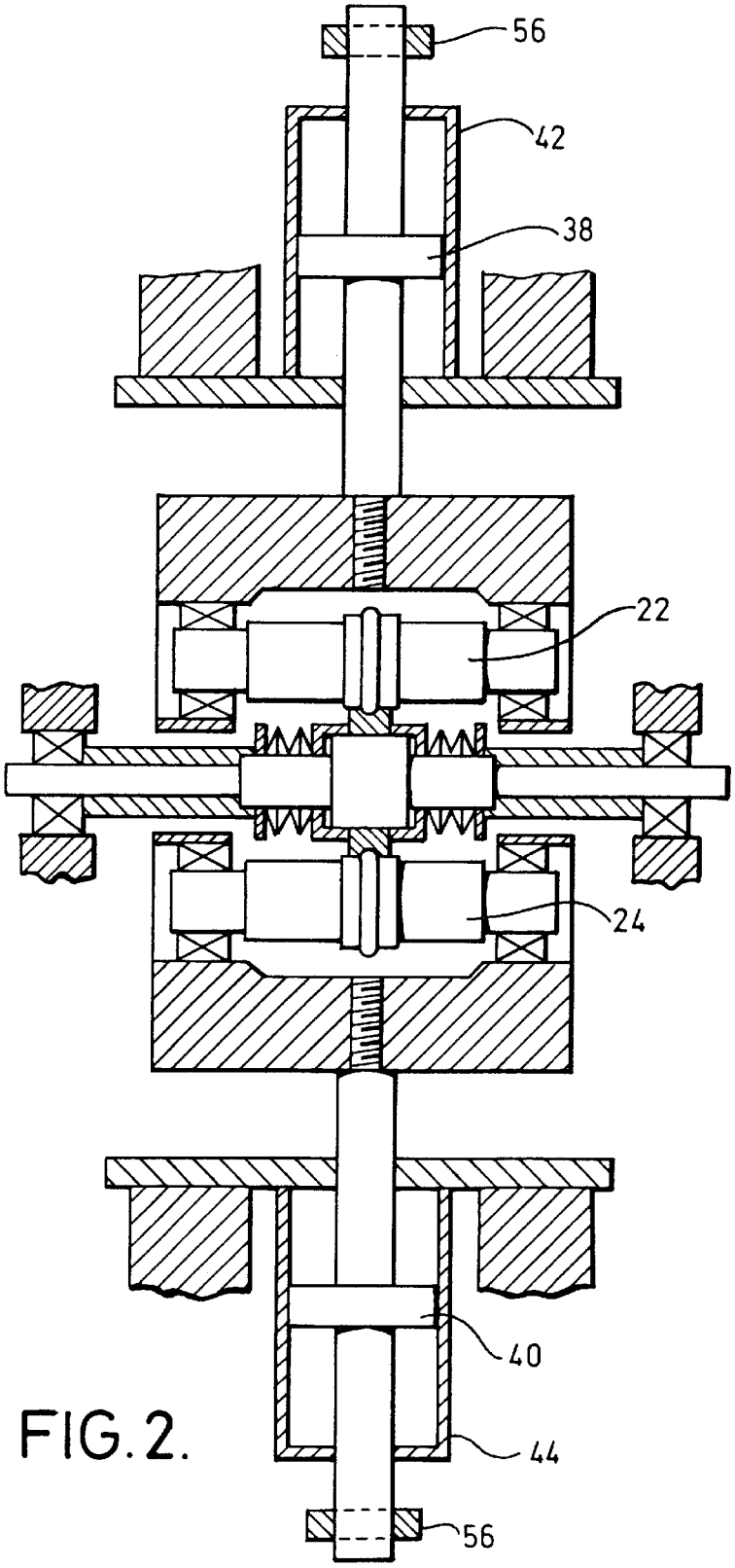
FIG. 2 is a detail cross-section of view showing one way in which the growth control rolls in the machine of FIG. 1 can be supported.

As mentioned above, when the forming rolls reach a predetermined depth of roll the force exerted by the growth control rolls 22 and 24 is increased. This is effected by means of valve 54. The growth control rolls 22 and 24 advance until they are prevented from advancing further by adjustable stops 56, as shown in FIG. 2. The growth control rolls are held against the stops by hydraulic pressure created by valve 46 remaining open during the first dwell period.

Figure 3:
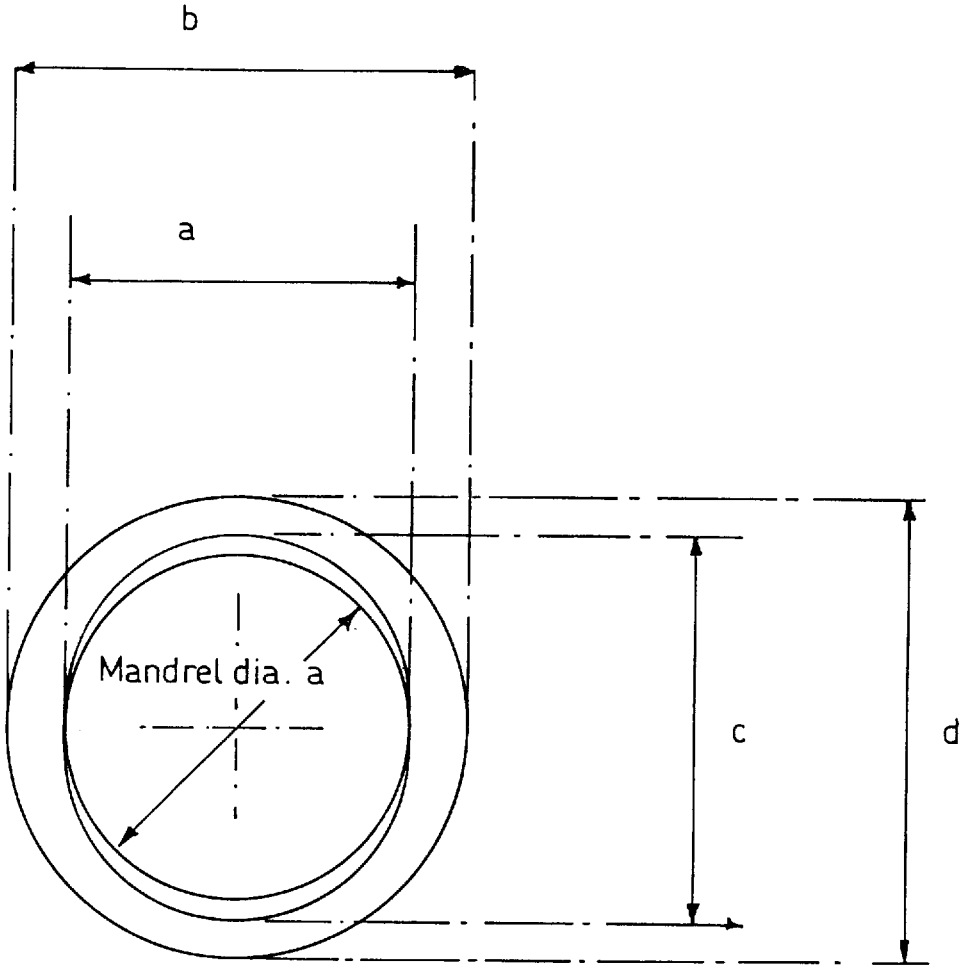
FIG. 3 shows part of the roll cycle at which the final ring size is reached but before the rounding process.

By automatically adjusting one or both of stops 56 before the rolling cycle is started to a position which is dependent on the weight of the workpiece it is possible to achieve various types of diameter control, including constant bore, constant outside diameter or constant mean diameter (equally sharing volume variations between the bore and outside diameter). This adjustment of one or both of stops 56 can be achieved by use of a stepper motor 58 which is controlled from unit 36 which is receiving the workpiece weight signal as mentioned above. The effect of this adjustment is to change the distance between the two sets of growth control rolls (FIG. 3, d) by a distance dependent on the variation from nominal weight of the workpiece (e.g. 0.04 millimetres per gramme) from a nominal distance.

FIG. 4 illustrates in tabular form the types of control that can be obtained using a nominal workpiece weight of 400 grammes with a tolerance of plus or minus 5 grammes and a wall thickness correction factor of 0.02 millimetres per gramme (as described in U.K. Patent Specification 1,475,477). In this example it can be seen that a zero growth control roll correction factor produces a constant mean diameter, a 0.04 millimetres per gramme growth control roll correction factor produces a constant bore and a minus 0.04 millimetres per gramme growth control roll correction factor produces a constant outside diameter after the rounding cycle (as described in U.K. Patent Specification 1,475,778).

Additionally, by adjusting the nominal position of these stops 56 a change in nominal rings diameters can be effected.

I claim:

1. A method of roll forming an annular workpiece in a rolling machine comprising two oppositely disposed forming rolls, at least one of which is movable towards and away from the other, and two oppositely disposed sets of growth control rolls having a line of action at right angles to the line of action of the forming rolls, which method comprises advancing at least one forming roll to roll form the workpiece to a wall thickness which is dependent on the weight of the workpiece, and controlling the advance of the growth control rolls to a position which is also dependent on the weight of the workpiece.

2. A method according to claim 1 wherein the advance of the forming rolls and of the growth control rolls is set in relation to the weight of the workpiece relative to that of a nominal workpiece.

3. A method according to claim 1 in which the final position of the growth control rolls is controlled in a manner that will produce a constant bore or a constant outside diameter or a constant mean diameter.

4. A method according to claim 1 or claim 2 in which the outside diameter of the workpiece before rounding, is controlled in the line of action of the growth control rolls and the bore size of the workpiece, before rounding is controlled in the line of action of the forming rolls.

5. A rolling machine for annular workpieces comprising two oppositely disposed forming rolls, at least one of which is movable towards and away from the other, and two oppositely disposed sets of growth control rolls having a line of action at right angles to the line of action of the forming rolls; a mandrel for mounting a workpiece; means for weighing a workpiece to be rolled; and means for controlling the advance both of the forming rolls and of the growth control rolls, which means is set in relation to signals from the weighing means.

6. A machine according to claim 5 wherein the means for controlling the advance of the growth control rings comprises stops.

7. A machine according to claim 5 or claim 6 wherein the means for controlling the advance of the growth control rolls comprises a stepping motor.

* * * * *